United States Patent [19]

Kimura et al.

[11] Patent Number: 4,820,954

[45] Date of Patent: Apr. 11, 1989

[54] INDIRECTLY HEATED CATHODE STRUCTURE FOR ELECTRON TUBES

[75] Inventors: Sakae Kimura, Tokyo; Touru Yakabe, Yokosuka; Mituo Kawai, Yokohama, all of Japan

[73] Assignee: Kabushiki Kaisha Toshiba, Kawasaki, Japan

[21] Appl. No.: 135,054

[22] Filed: Dec. 18, 1987

[30] Foreign Application Priority Data

Dec. 19, 1986 [JP] Japan ..... 61-301360

[51] Int. Cl.[4] ..... H01J 1/94

[52] U.S. Cl. ..... 313/270; 313/337

[58] Field of Search ..... 313/270, 337, 346 R; 420/425, 426

[56] References Cited

U.S. PATENT DOCUMENTS 2,673,277 3/1954 Lemmens et al. ..... 313/337

4,570,099 2/1986 Green ..... 313/346 R

OTHER PUBLICATIONS

*Reinhold Publishing Company,* (1960), pp. 538-541, "Materials and Techniques For Electron Tubes"; Walter H. Kohl.

*Primary Examiner*—David K. Moore

*Assistant Examiner*—Michael Horabik

*Attorney, Agent, or Firm*—Oblon, Fisher, Spivak, McClelland & Maier

[57] ABSTRACT

An indirectly heated cathode structure for electron tubes comprises a cathode supporting sleeve, an electron emission section fitted on a part of the supporting sleeve, and a heater arranged inside the supporting sleeve, the supporting sleeve being an alloy containing niobium as a main component, more particularly more than 85 weight % of niobium. As an additive, at least one metal selected from titanium, zirconium, hafnium, vanadium, tantalum, molybdenum and tungsten is used.

16 Claims, 2 Drawing Sheets

INDIRECTLY HEATED CATHODE STRUCTURE FOR ELECTRON TUBES

BACKGROUND OF THE INVENTION

This invention relates to an indirectly heated cathode structure which emits high current density electron beams in electron tubes.

The indirectly heated cathode structure used in the above electron tubes, such as high definition color picture tubes, high-grade pick-up tubes, projection tubes or travelling tubes, usually has a construction in which a supporting sleeve supports a disc-shaped electron emission section. Since, apart from the heater inserted in the sleeve, this cathode supporting sleeve is the part which is exposed to the highest temperature, i.e. 1000° C., it must have a sufficiently high mechanical strength at high temperature Generally, the thicker the supporting sleeve, the higher its mechanical strength. However, a thicker sleeve increases the weight, and it becomes difficult to make the structure compact. Moreover, with a thicker sleeve there would be increased heat loss due to increased heat conduction, and this would result in the disadvantage of requiring greater power for heating. In particular, in the case of an impregnated type cathode structure, a comparatively high operating temperature of 900° C. to 1000° C. (brightness temperature) is typical. Moreover, in the aging process which is carried out prior to use of an electron tube, the sleeve is sometimes heated to approximately 1200° C. Furthermore, electron tubes in which these indirectly heated cathode structures are used are sometimes mounted in satellites, aircraft, ships or automobiles, and therefore more stringent vibration-proofing is required. For these reasons, tantalum (Ta) has been used for the supporting sleeves of conventional impregnated cathode structures.

However, tantalum sleeves often deform at high temperature due to mechanical shocks or vibrations.

It has been suggested in literature that pure niobium, pure tantalum or pure molybdenum might be used as a supporting sleeve (Japanese Patent Application Laid-open No. 54-67757). However, since the strength of niobium at high temperature is lower than that of tantalum, niobium has not been used in practice.

SUMMARY OF THE INVENTION

Therefore, an object of this invention is to provide an indirectly heated cathode structure for electron tubes which solves the above problem and has improved resistance to vibration, better heat resistance, easy workability and reduced heat capacity.

According to this invention, an indirectly heated cathode structure for an electron tube comprises electron emission means for emitting electrons in response to heat, heating means adjacent to the electron emission means for supplying heat to the emission means, and niobium alloy cathode supporting sleeve means for supporting the emission means and the heating means and increasing the vibration resistance of the cathode structure.

The sleeve means preferably includes an alloy containing at least 85 weight % niobium and at least One metal selected from the group consisting of titanium, zirconium, hafnium, vanadium, tantalum, molybdenum and tungsten.

The inventors have found that the specific gravity has an effect on the supporting sleeve deformation at high temperature compared with the mechanical strength of material. The respective specific gravities of pure Nb, Ta and Mo are 8.6, 16.6 and 10.3 respectively. The specific gravity of Nb is lower than that of Ta or Mo. On the other hand, the mechanical strength at high temperature of Nb is much less than that of Ta or Mo. Overall, the Ta supporting sleeve is superior. However, a Nb alloy supporting sleeve has improved characteristics against sleeve deformation. In the same size sleeve, the weight of a Nb alloy sleeve can be reduced by 50 % or more. Moreover, a thin sleeve can be manufactured stably by a drawing process. Also, a Nb alloy sleeve can withstand heat wear generated by frequent heating and cooling, Yet its resistance to vibration does not deteriorate.

DETAILED DESCRIPTION OF PREFERRED EMBODIMENT

Figure 1:
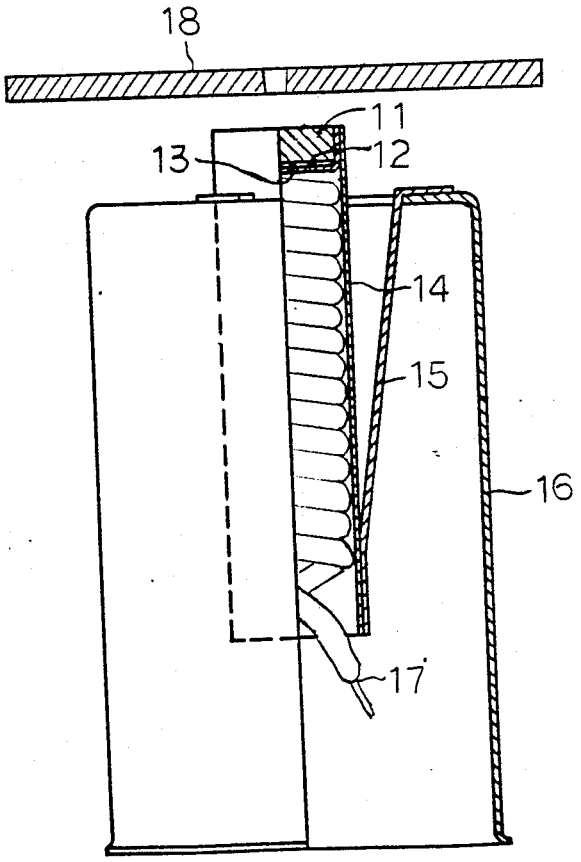
FIG. 1 is a vertical cross sectional view showing a cut-away portion of one embodiment of this invention.

The embodiments of this invention are explained below with reference to drawings. These embodiments are applied to an impregnated cathode structure, as shown in FIG. 1.

A disc-shaped electron emission section 11 is formed of porous tungsten, which is impregnated with an electron emission substance, e.g. barium calcium aluminate, and its surface is coated with an iridium-tungsten alloy (Ir-W) layer for lowering the cathode operating temperature. By this coating, the impregnated cathode can operate at a temperature below 1100° C. Such a low operating temperature is convenient for use Of a Nb alloy cathode supporting sleeve. Disc-shaped electron emission section 11 is put into a metal cup 13 which has a cylindrical shape with a bottom. the cup 13 is mounted in the end of a cathode supporting sleeve 14, and fine rhenium (Re) wires 12 are disposed in the cup 13 for Welding. The emission section 11 is welded by means of wires 12. The external surface of cup 13 is secured to cathode supporting sleeve 14. The bottom end of cathode supporting sleeve 14 is secured to an outer supporting cylinder 16 formed of Kovar, i.e. a Fe-Ni-Co alloy. Three supporting straps 15 composed of a 1% Zr-Nb alloy join the sleeve 14 to the cylinder 16. A coiled filament heater 17, coated with an insulating material for heating, is inserted inside cathode supporting sleeve 14, closely contacted to cup 13. A first grid electrode 18 is arranged against electron emission section 11. The cathode structure, together with various grid electrodes containing first grid electrode 18, is assembled into an electron gun structure, which is mounted in an electron tube.

Cathode supporting sleeve 14 first is produced as a cap of external diameter 1.6 mm and thickness 25 μm from an alloy plate containing niobium of 99 weight % and zirconium of 1 weight %. After rolling and pressing, the cap shape is then made into a sleeve of length 6.4 mm by a known laser process.

Figure 2:
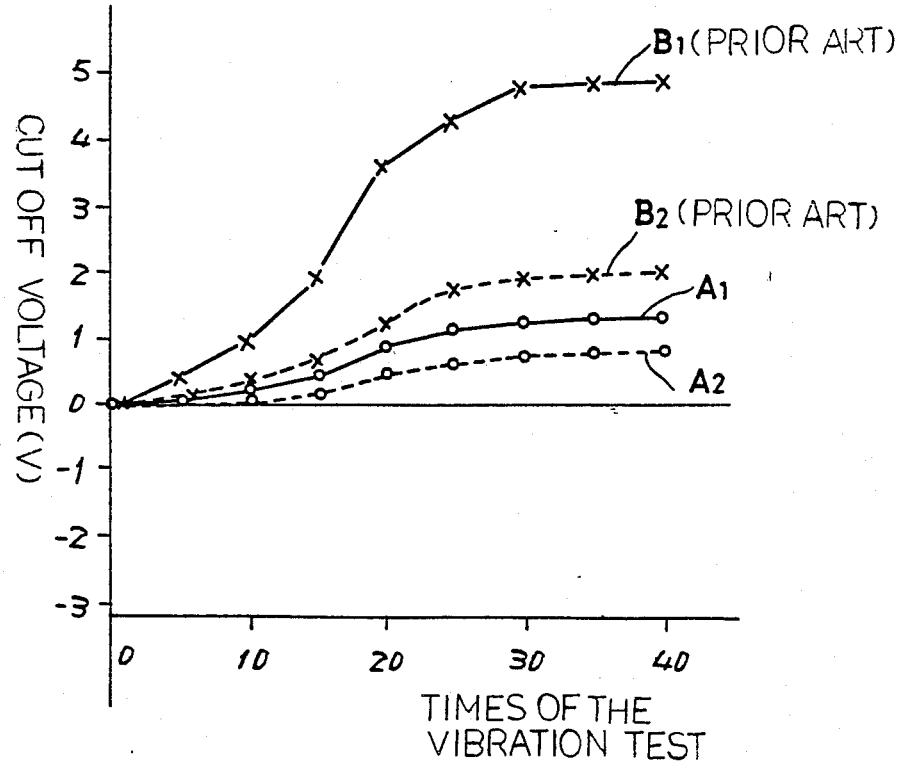
FIG. 2 shows characteristic curves of cut-off voltage versus repetitions of the vibration test.

The indirectly heated cathode structure is mounted into a triode for emission characteristic testing and for evaluation of the deformation of the sleeve by vibration tests. This evaluation includes a comparison of the emission characteristics and cut-off voltage characteristics before and after vibration testing. Data in curve A1 shown in FIG. 2 was obtained for the results of the cut-off voltage characteristic. Also, for the evaluation of the sleeve material, as a conventional example, a cathode structure which used a Ta supporting sleeve with identical shape and dimensions was produced and evaluated in the same way. The results were as shown in curve B1 in the same Figure. The vibration test was carried out repeatedly using a random mode, effective acceleration 10G, bandwidth 2000 Hz and time for 1 vibration test 2 minutes. Also, for comparison, vibration-proofing was evaluated in the same ay for cathode structures using Nb alloy cathode supporting sleeves and Ta cathode supporting sleeves with sleeve thickness of 100 μm and 200 μm. As a result, in the case of the 200 μm thickness sleeves there was almost no difference in vibration due to the sleeve material. That is to say, there was almost no cut-off voltage characteristic variation in the electron tube. As opposed to this, in the case of the 100 μm thickness sleeves, the Nb alloy sleeve was superior. That is to say, in FIG. 2, curve A2 shows the results for the Nb alloy sleeve of 100 μm thickness and curve B2 is for a Ta sleeve of the same thickness.

From these results it is clear that an indirectly heated cathode structure which uses a Nb alloy cathode supporting sleeve can reduce the variation of the cut-off voltage of an electron tube when compared with a cathode structure having a Ta sleeve. This result means that deformation due to the vibration tests was very small with the Nb alloy material, which has a relatively small specific gravity, and this shows that the cathode structure relating to this invention is superior in vibration resistance.

Also, the Nb alloy material has comparatively good workability. Press moulding and continuous drawing into a narrow sleeve shape can be carried out both easily and stably, and the material has excellent mass-produceability.

For the Nb alloy material, besides the above embodiment, alloys containing Nb as a main component and other metals as additives may also be used. As examples (Embodiment 1 to Embodiment 19), Table 1 shows alloy compositions of sleeves, cut-off voltage variations and drawing processabilities to sleeve shape of a Nb alloy material as compared with pure Nb and pure Ta materials (Example 1 and Example 2).

This test was carried out as follows:

An indirectly heated cathode structure was assembled into a triode capable of being tested for emission characteristic, and the variation of the cut-off voltage after intermittent operation with the heater ON and OFF was evaluated.

The temperature of the surface of the electron emission section was increased by the heater to a brightness temperature of 1100° C., which was higher than the normal working temperature. It was tested for 500 hours with a schedule of power ON for 5 minutes and OFF for 10 minutes.

TABLE 1

| Sample | Chemical Composition (wt. %) | | | | | | | | Cut-off Voltage variation (V) | Workability |
|---|---|---|---|---|---|---|---|---|---|---|
| | Ti | Zr | Hf | V | Ta | Mo | W | Nb | | |
| Embodiment 1 | — | 0.2 | — | — | — | — | — | 99.8 | 1.3 | Excellent |
| Embodiment 2 | — | 1.0 | — | — | — | — | — | 99.0 | 0.5 | Excellent |
| Embodiment 3 | — | 6.0 | — | — | — | — | — | 94.0 | 0.2 | Satisfactory |
| Embodiment 4 | — | — | 3 | — | — | — | — | 97.0 | 1.0 | Excellent |
| Embodiment 5 | — | — | 15 | — | — | — | — | 85.0 | 0.2 | Satisfactory |
| Embodiment 6 | 1.0 | — | 3 | — | — | — | — | 96.0 | 0.5 | Good |
| Embodiment 7 | — | 1.0 | 10 | — | — | — | — | 89.0 | 0.2 | Good |
| Embodiment 8 | — | — | — | 1.0 | — | — | — | 99.0 | 1.3 | Excellent |
| Embodiment 9 | — | — | — | 6 | — | — | — | 94.0 | 0.8 | Satisfactory |
| Embodiment 10 | — | 1.0 | — | 4 | — | — | — | 95.0 | 0.8 | Good |
| Embodiment 11 | — | — | — | — | — | 2 | — | 98.0 | 0.7 | Excellent |
| Embodiment 12 | — | — | — | — | — | 7 | — | 93.0 | 0.2 | Satisfactory |
| Embodiment 13 | — | — | — | — | — | — | 0.5 | 99.5 | 0.6 | Excellent |
| Embodiment 14 | — | — | — | — | — | — | 3 | 97.0 | 0.2 | Satisfactory |
| Embodiment 15 | — | — | — | — | 2 | — | — | 98.0 | 0.9 | Good |
| Embodiment 16 | — | — | — | — | 5 | — | — | 95.0 | 0.4 | Satisfactory |
| Embodiment 17 | — | 0.75 | — | — | — | 2 | — | 97.25 | 0.5 | Excellent |
| Embodiment 18 | — | 0.75 | — | — | — | — | 0.5 | 98.75 | 0.4 | Excellent |
| Embodiment 19 | — | 0.75 | — | — | 2 | — | — | 97.25 | 0.7 | Good |
| Comparative | | | | | | | | | | |
| Example 1 | — | — | — | — | — | — | — | 100 | 1.5 | Excellent |
| Example 2 | — | — | — | — | 100 | — | — | — | 5.3 | Satisfactory |

As is clear from the results of these embodiments, suitable ranges can be specified for the amounts of each metal to be added. That is to say, when the metal to be added is mainly a single metal and when that metal is zirconium, the range is 0.5 to 0.6 weight %. Similarly, for hafnium it is 3 to 15 weight %, for vanadium 1 to 6 weight %, for molybdenum 2 to 7 weight %, for tungsten 0.3 to 3 weight % and for tantalum it is 2 to 5 weight %.

On the other hand, in the case of combined addition, the ranges are as follows: hafnium-3 to 10 weight % and titanium-0.2 to 3.0 weight %: hafnium-3 to 10 weight % and zirconium-0.2 to 2.0 weight %; vanadium-1 to 4 weight % and zirconium-0.2 to 2.0 weight %; molybdenum-2 to 7 weight % and zirconium-0.2 to 1.0 weight %; tungsten-0.5 to 3.0 weight % and zirconium-0.2 to 1.0 weight %. For the upper limits of these amounts, in practice, the sleeve workabilities are mainly at the upper limit values, and the lower limits correspond to the lower limit values at which a marked effect occurs on the wear resistance characteristic. The maximum value of the additives is about 15 weight %.

In the data shown in Table 1, it is possible to form sleeves with "excellent", "good" and "satisfactory" workability. and when the cut-off voltage is 2.0 V or less a marked effect will be displayed. Incidentally, "satisfactory" is the lower limit of practical feasibility.

Moreover, for the effect of sleeve thickness on the cut-off variation, sleeves were produced with thickness of 50 μm, 75 μm and 100 μm using pure niobium and niobium with 0.75 weight % zirconium alloy, and the above-mentioned ON/OFF test was carried out. As a result, with 75 μm and 100 μm sleeves, almost no difference of wear resistance characteristic due to the sleeve material, that is to say variation of the cut-off voltage of the electron tube, could be observed. On the other hand, with a sleeve thickness of 50 μm, the Nb-Zr alloy sleeve was superior.

From these results it is clear that an indirectly heated cathode structure which uses a niobium alloy exhibits an excellent heat resistance characteristic and this makes the cut-off variation during its life very small.

The additional amount for alloying is very small and, while maintaining the good vibration resistance characteristic of a pure niobium sleeve, it has a superior heat resistance characteristic as compared to a pure niobium sleeve, and can withstand more severe working conditions. As a result, a high-performance electron tube can be achieved.

The disc-shaped electron emission section was installed in the sleeve via a cup, but the disc-shaped electron emission section can also be installed directly into the sleeve. However, in this case, it is necessary to provide shielding material below the disc-shaped electron emission section to shield against evaporation or permeation of the electron emitting substance in the direction of the heater.

The above is an explanation of the case of an impregnated cathode. However, this invention can be extensively applied for indirectly heated cathode structures with oxide cathodes, etc.

As explained above, according to this invention, cathode sleeves can be composed of reinforced niobium alloys, having a relatively low specific gravity and a comparatively small heat capacity. Consequently, as indirectly heated cathode structures, they have good vibration resistance characteristics, and relative reductions of the power required to heat them are also possible. Furthermore, a cathode structure can be provided with an excellent heat wear resistance characteristic against the repeated heating of the cathode, and this contributes greatly to the production of a high-reliability, high-performance electron tube. Also, such a sleeve has good workability for such processes as drawing to produce a long and narrow thin sleeve, and it may be easily mass produced.

We claim:

1. An indirectly heated cathode structure for an electron tube, comprising:

electron emission means for emitting electrons in response to heat;

heating means adjacent to the electron emission means for supplying heat to the emission means; and niobium alloy cathode supporting sleeve means for supporting the emission means and the heating means and increasing the vibration resistance of the cathode structure, wherein the sleeve means comprises an alloy containing at least 85 wt. % niobium and at least one metal selected from the group consisting of titanium, zirconium, hafnium, vanadium, tantalum, molybdenum and tungsten.

2. The indirectly heated cathode structure of claim 1, wherein the sleeve means includes a supporting sleeve having a maximum thickness of 50 μm.

3. The indirectly heated cathode structure of claim 1, wherein the alloy contains zirconium in a range of 0.2 to 6.0 weight %.

4. The indirectly heated cathode structure of claim 1, wherein the alloy contains hafnium in a range of 3 to 15 weight %.

5. The indirectly heated cathode structure of claim 2, wherein the alloy contains hafnium in a range of 1 to 6 weight % and one of titanium in a range of 0.2 to 3.0 weight % and zirconium in a range of 0.2 to 2.0 weight %.

6. The indirectly heated cathode structure of claim 1, wherein the alloy contains vanadium in a range of 1 to 6 weight %.

7. The indirectly heated cathode structure of claim 1, wherein the alloy contains vanadium in a range of 1 to 4 weight % and zirconium in a range of 0.2 to 2.0 weight %.

8. The indirectly heated cathode structure of claim 1, wherein the alloy contains molybdenum in a range of 2 to 7 weight %.

9. The indirectly heated cathode structure of claim 1, wherein the alloy contains tungsten in a range of 0.5 to 3.0 weight %.

10. The indirectly heated cathode structure of claim 1, wherein the alloy contains tungsten in a range of 2 to 5 weight %.

11. The indirectly heated cathode structure of claim 8, wherein the alloy contains zirconium in a range of 0.2 to 1.0 weight %.

12. The indirectly heated cathode structure of claim 9, wherein the alloy contains zirconium in a range of 0.2 to 1.0 weight %.

13. The indirectly heated cathode structure of claim 10, wherein the alloy contains zirconium in a range of 0.2 to 1.0 weight %.

14. The indirectly heated cathode structure of claim 1, wherein the electron emission means includes a cathode disc of porous tungsten impregnated with barium-calcium-aluminate.

15. The indirectly heated cathode structure of claim 14, wherein the sleeve means includes an elongated supporting sleeve, and the electron emission means includes a metal cup fixed at one end of the supporting sleeve for supporting the cathode disc.

16. An indirectly heated cathode structure for electron tubes comprising:

an elongated cathode supporting sleeve;

an electron emission section fitted on one end of the supporting sleeve; and a heater arranged inside the supporting sleeve, the supporting sleeve comprising an alloy consisting essentially of niobium as a main component, wherein the sleeve comprises an alloy containing at least 85 wt. % niobium and at least one metal selected from the group consisting of titanium, zirconium, hafnium, vanadium, tantalum, molybdenum and tungsten.

* * * * *